United States Patent [19]

Dellinger

[11] Patent Number: 4,784,777

[45] Date of Patent: Nov. 15, 1988

[54] PRINTING BLANKET RESTORATION

[75] Inventor: Matthew H. Dellinger, Cherryville, N.C.

[73] Assignee: Smash, Inc., Lumberton, N.C.

[21] Appl. No.: 21,615

[22] Filed: Mar. 2, 1987

Related U.S. Application Data

[63] Continuation of Ser. No. 753,035, Jul. 8, 1985, abandoned.

[51] Int. Cl.[4] ..... B29C 43/02; B29D 24/00

[52] U.S. Cl. ..... 252/8.7; 252/8.8; 252/174.16; 252/174.21; 252/546; 252/553; 252/559; 427/140; 428/262

[58] Field of Search ..... 252/174.16, 174.21, 252/546, 553, 559, 8.7, 8.8

[56] References Cited

U.S. PATENT DOCUMENTS

| | | | |
|---|---|---|---|
| 3,285,799 | 11/1966 | Peterson | 428/167 |
| 3,881,045 | 4/1975 | Strunk | 225/94 |
| 4,042,743 | 8/1977 | Larson et al. | 428/246 |
| 4,086,386 | 4/1978 | Gaworowski et al. | 428/321.5 |
| 4,107,067 | 8/1978 | Murphy et al. | 252/135 |
| 4,265,782 | 5/1981 | Armstrong et al. | 252/174.19 |
| 4,375,421 | 3/1983 | Rubin et al. | 252/110 |
| 4,381,259 | 4/1983 | Homma et al. | 252/542 |
| 4,544,494 | 10/1985 | Downey et al. | 252/135 |
| 4,555,360 | 11/1985 | Bisset et al. | 252/541 |

OTHER PUBLICATIONS

Technical Data, Jortaine CAB-35, Jordan Chemical Company.

Technical Data, Jorphox, Jordan Chemical Company.

*Primary Examiner*—A. Lionel Clingman

[57] ABSTRACT

The present invention provides a novel composition useful for restoring a fabric in need of restoration due to compression thereof, for example the fabric backing of a printing blanket, in particular a smashed printing blanket. The composition includes a sulfated fatty alcohol anionic surfactant, a sulfonated alkylaryl anionic surfactant, and an organic phosphate ester surfactant. Also provided is a printing blanket, to which the novel composition has been applied, as well as an improved method for restoring a printing blanket.

18 Claims, No Drawings

PRINTING BLANKET RESTORATION

This is a continuation of copending application Ser. No. 753,035 filed July 8, 1985, abandoned.

TECHNICAL FIELD

This invention relates to a novel composition useful for restoring printing blankets, to printing blankets pretreated with this composition, and to the use of this composition for restoring printing blankets.

BACKGROUND ART

Various combinations of surfactants are exemplified by U.S. Pat. Nos. 4,381,259 to Homma et al, 4,265,782 to Armstrong et al, and 4,375,421 to Rubin et al. The Homma et al patent is directed to a shampoo composition employing an anionic phosphoric acid ester surfactant, a cationic polymer, and at least one other surfactant that may be an anionic organic surfactant other than the phosphoric acid ester surfactant, a nonionic organic surfactant, or an amphoteric organic surfactant. Armstrong et al describe a relatively high viscosity, detergent composition that includes a modified rosin ester and at least one other surfactant selected from anionic, nonionic, cationic and amphoteric surfactants. The Rubin et al patent pertains to viscous compositions containing amido betaines and salts, which may additionally contain about 2.5 to 4.0% of a micelle-forming anionic surfactant.

Conventional printing blankets in use throughout the printing industry, in particular in offset lithography, are made with a vulcanized elastomeric face, which may be a soft rubber, and a fabric backing, which is typically a multi-ply, woven cotton fabric. In offset lithography, these blankets serve to transfer printing ink from a printing plate to paper being printed. During this ink transfer, intimate contact between the contacting surfaces is essential. Intimate contact is ordinarily achieved by positioning the blanket-covered cylinder and the cylinder it contacts, so that the printing blanket is compressed throughout the ink transfer.

However, a problem is that a blanket used to print envelopes generally cannot thereafter be used to print paper, as ghosts of the envelope will appear on the paper sheets. Moreover, misfeeds occasionally occur in which extra sheets of paper cause a "smash," that is, a permanent, impact-caused compression of a portion of the fabric backing of the blanket. Typically, the elastomeric blanket face is not marred or broken by a smash.

Because of known drawbacks to conventional printing blankets, there are improved blankets such as the compressible offset printing blanket of U.S. Pat. No. 4,042,743 to Larson et al, the smash-resistant offset printing blankets of U.S. Pat. No. 3,285,799 to Peterson and U.S. Pat. No. 3,881,045 to Strunk, and the smash-recoverable printing blanket of U.S. Pat. No. 4,086,386 to Gaworowski et al. The Gaworowski et al printing blanket contains microcapsules disposed in a layer thereof, which when the blanket is smashed, release a liquid that causes the layer to swell and that thereby effects blanket restoration. The liquid may be water or a water solution, and is described as being any suitable liquid that produces swelling or expansion of the fabric layers with which it comes into contact.

Nevertheless, the conventional printing blanket remains in wide use, and if for one reason or another the blanket becomes unsuitable for further use even though its elastomeric face is not marred or broken in any way, it is removed from the cylinder and replaced. Therefore, there is a need for a composition for restoring a conventional printing blanket having an unmarred or unbroken elastomeric face but in need of restoration, in particular a smashed printing blanket. Such a composition would be remarkable if it could provide more than a few additional hours of useful press life. Furthermore, if for at least 5% of the smashes, a blanket treated with the composition prior to being smashed, would be restored by the prior-applied composition, the composition would provide an even greater contribution to the art. Such a composition should be non-injurious to the elastomeric blanket face, and would be especially advantageous if it could be easily and safely applied to the blanket. In addition, such a composition would provide an improved method of restoring a conventional printing blanket having an unmarred or unbroken elastomeric face but in need of restoration.

DISCLOSURE OF THE INVENTION

It is accordingly an object of the present invention to provide a novel composition for restoring a conventional printing blanket having an unmarred or unbroken elastomeric face but in need of restoration, in particular a smashed printing blanket.

It is a further object of the present invention to provide a composition that provides more than a few additional hours of useful press life to the restored blanket.

It is an even further object to provide a composition that, when applied to a blanket prior to a smash, restores the pretreated blanket, in the case of at least 5% of the smashes.

It is a still further object to provide a composition that is non-injurious to an elastomeric blanket face, and is easily and safely applied to the blanket.

It is an additional object to provide an improved method of restoring a conventional printing blanket having an unmarred or unbroken elastomeric face but in need of restoration.

Additional objects, advantages and novel features of the present invention are set forth in the description that follows, and in part will become apparent to those skilled in the art upon examination of the following description or may be learned by practice of the invention.

To achieve the foregoing objects and in accordance with the purpose of the present invention, as embodied and broadly described herein, there is provided a thick viscous liquid composition useful for restoring a printing blanket having an unmarred or unbroken elastomeric face but in need of restoration due to compression of the fabric backing thereof. The composition includes as ingredients in an aqueous-based solvent, a sulfated fatty alcohol anionic surfactant, a sulfonated alkylaryl anionic surfactant, and an organic phosphate ester surfactant that may be anionic or amphoteric. The composition further includes a nonionic surfactant, or both a water-soluble salt and an amphoteric surfactant that is not an amphoteric organic phosphate ester surfactant.

The ingredients are individually present in the composition in an amount sufficient to provide restoring of the blanket when a sufficient amount of the composition has been applied to the fabric backing. The composition is free of an amount of a cationic compound sufficient to otherwise prevent restoring of the blanket.

Also provided is a printing blanket including an elastomeric face, which is unmarred or unbroken, and a fabric backing, to the fabric backing of which is applied an amount of the thick viscous liquid composition of the present invention, sufficient for restoring the blanket.

In addition, there is provided a method for restoring a printing blanket having an unmarred or unbroken elastomeric face but in need of restoration due to compression of the fabric backing thereof. The method includes applying the thick viscous liquid composition of the present invention, to the fabric backing of the printing blanket in an amount sufficient for restoring the blanket.

BEST MODE FOR CARRYING OUT THE INVENTION

As explained earlier, the present invention is directed to a novel composition useful for restoring a conventional printing blanket having an unmarred or unbroken elastomeric face but in need of restoration. For the purpose of describing and claiming this invention, by the term "restoring" I do not necessarily imply complete, that is 100%, restoration. Rather, I mean that the blanket is at least about 94% restored, since about 94% restoration will suffice, for example, with certain inks on certain substrates. Nevertheless, it will generally be desirable for about 98 to 100% restoration to be effected, as illustrated by the formulations of Examples 2 and 10 herein. For most inks, about 98% restoration will be satisfactory, but for blue ink, restoration should be complete.

Advantageously, my novel composition typically permanently restores a blanket. By "permanently" is meant that the treated blanket is returned to the useful press life that it had prior to occurrence of, for example, the smash. Remarkably, for at least 5 to 10% of the smashes, a blanket treated with my novel composition prior to being smashed, is restored by the prior-applied composition. Beneficially, my novel composition can be easily and safely applied to the blanket, and is noninjurious to the elastomeric blanket face.

My novel composition is based upon my surprising discovery that a particular blend of anionic surfactants, a phosphate ester surfactant, and either a nonionic surfactant, or both an amphoteric surfactant and a water-soluble salt, in an aqueous-based solvent, provides a thick viscous liquid useful for permanently restoring a conventional printing blanket having an unmarred or unbroken elastomeric face but in need of restoration. I have further discovered that this thick viscous liquid must be free of an interfering amount of a cationic compound, such as a cationic polymer or surfactant. By an "interfering amount" is meant an amount of the cationic compound that would prevent my novel composition from restoring the blanket.

The thick viscous liquid composition of the present invention, which suitably has an approximately neutral pH, for example, about 6.8, requires as essential ingredients in the aqueous-based solvent, a sulfated fatty alcohol anionic surfactant, a sulfonated alkylaryl anionic surfactant, and an organic phosphate ester surfactant that may be anionic or amphoteric. Typically, the composition will contain about 9 to 30%, preferably about 15 to 22%, of the two anionic surfactants and the phosphate ester surfactant, of which about 7 to 23%, preferably about 13 to 20%, will usually be the sulfated fatty alcohol and sulfonated alkylaryl anionic surfactants.

The aqueous-based solvent is conveniently water and makes up the balance of the composition after the various ingredients have been combined. Accordingly, the ingredients should be water-miscible or water-soluble.

An anionic surfactant useful in my composition, will usually be a salt of an alkali metal such as sodium or potassium, an ammonium salt, or a salt of an amine such as an alkanolamine having 1 to 3 alkanol groups each of 2 to 3 carbon atoms such as mono-, di-, or triethanolamine. However, an anionic organic phosphate ester surfactant may be in the free-acid form.

The sulfated fatty alcohol anionic surfactant will typically include a straight chain or branched alkyl group of about 10 to 20, conveniently about 12 to 16, carbon atoms. Suitably, this surfactant will be about 1 to 10%, preferably about 4 to 8%, of the novel composition of the present invention. Useful sulfated fatty alcohol anionic surfactants include, but are not limited to, sodium lauryl sulfate, ammonium lauryl sulfate, sodium tallow alcohol sulfate and ammonium tallow alcohol sulfate.

The sulfonated alkylaryl anionic surfactant will typically have a straight chain or branched alkyl group of about 10 to 16 carbons atoms. This anionic surfactant will usually be about 3 to 20%, preferably about 9 to 16%, of the novel composition of the present invention. Suitable anionic surfactants of this type are exemplified by sodium dodecylbenzenesulfonate and triethanolamine dodecylbenzene sulfonate.

The organic phosphate ester surfactant may be anionic or amphoteric, may be a monoester, a diester, or a mixture of a mono- and diester, and may be in the salt or free-acid form. This surfactant will typically include an unbranched or branched alkyl or alkenyl group containing about 8 to 22 carbon atoms, with suitably either none or an integer from 1 to about 10, beneficially about 2 to 6, of ethyleneoxy moieties per side chain. The alkyl or alkenyl group may be directly bonded to a nitrogen in the form of an amine oxide, which is linked to the phosphate group through a short chain alkylene oxide moiety of typically about two carbons. The nitrogen may also have a hydroxylated, short chain alkyl substituent that is suitably a hydroxyethyl moiety. The phosphate ester surfactant will usually be about 0.5 to 10%, preferably about 1 to 8%, of my novel composition.

Illustrative types of organic phosphate ester surfactants include, but are not limited to, an alkali metal salt of a phosphated, ethoxylated $C_{8-18}$-alkyl and -alkenylamine oxide, which may be amphoteric at approximately neutral pH, and a free-acid form of an anionic, polyethoxylated $C_{8-12}$-alkyl ether phosphate having about 2 to 6 oxyethylene groups per side chain. A specific example of the first type of phosphate ester is the potassium salt of a complex mono- and diester mixture of a phosphated n,n-bis(hydroxyethyl) coco amine oxide, which is sold by Jordan Chemical Company as Jorphox KCAO, and a specific example of the second type of phosphate ester is a free-acid form of a complex mono- and diester mixture of polyoxyethylene(4)decyl ether phosphate, which has an acid number (mg KOH/g) of about 125 to 135 at about pH 5.0 to 5.5, and which is available under the name Cedephos FA-600M from Miranol Chemical Company, Inc.

A further essential ingredient in my novel composition is either a nonionic surfactant, or both a water-soluble salt and an amphoteric surfactant. It is to be understood that the amphoteric surfactant is not the same as the organic phosphate ester surfactant, which may be amphoteric. In other words, my novel composition may contain both an amphoteric organic phosphate ester surfactant and the amphoteric surfactant.

The nonionic surfactant may be a polyoxyalkylenealkyl or alkenyl ether having a primary or secondary alkyl or alkenyl group containing about 8 to 20, typically about 10 to 16, carbon atoms, and about 5 to 100, suitably about 3 to 15, alkylene oxide units. Each alkylene moiety beneficially includes 2 or 3 carbon atoms. Conveniently, about 1 to 10%, preferably about 2 to 8%, of the nonionic surfactant will be used.

Exemplary nonionic surfactants include, but are not limited to, alkyloxypolyethylenoxyethanols having a $C_{12-14}$-alkyl group. A suitable alkyloxypolyethylenoxyethanol is a mixture of 83% of a $C_{12-14}$-alkyloxypolyethylenoxyethanol having about 12 ethylene oxide units per molecule, and 17% of a $C_{12-14}$-alkyloxypolyethylenoxyethanol having an average of 5 ethylene oxide units per molecule. This 83%/17% mixture is available from Union Carbide under the trade mark Tergitol® Autoseptic® HD, PM 4870.

The amphoteric surfactant, which prevents flaking of the applied composition from the printing blanket, may be, for example, a betaine surfactant. As stated earlier, the amphoteric surfactant is not the same as the organic phosphate ester surfactant, which may be amphoteric. A useful amount of the amphoteric surfactant will be in the range of about 0.8 to 8%, preferably about 2 to 6%.

Included in the class of betaine surfactants are alkylamido betaines, alkylamino betaines and alkyl betaines. The alkyl is typically a fatty alkyl or alkenyl chain of about 8–20 carbon atoms and, in the case of the first two types of betaines, there is a linking alkylene moiety having generally two to four carbon atoms.

Examples of betaine amphoteric surfactants include, but are not limited to, cocoamido betaine, cocoamino betaine and coco betaine. Cocoamido betaine is available from Jordan Chemical Company under the name Jortaine CAB-35.

As indicated earlier, if the amphoteric surfactant is used in place of the nonionic surfactant, the composition must include the water-soluble salt. A small amount of the water-soluble salt is typically sufficient, that is, on the order of about 0.5 to 2%. Although more than a small amount could be used, no advantage will usually be gained. Conveniently, the water-soluble salt will be an inorganic salt such as an alkali metal halide. An illustrative alkali metal halide is sodium chloride.

A preferred formulation of my novel composition, which produces about 98 to 100% restoration, contains the two anionic surfactants, the organic phosphate ester surfactant, the nonionic surfactant, and either the water-soluble salt or the amphoteric surfactant. If the water-soluble salt and amphoteric surfactant are used together in a variation of this formulation and in addition a chelating agent and a preservative are included, a very highly preferred formulation of a composition according to the present invention, is provided.

An exemplary chelating agent for use in my novel composition is EDTA, and a suitable preservative is formaldehyde. Generally, about 1% of the chelating agent will be efficacious, and about 0.02% of formaldehyde will function as an effective preservative.

Beneficially, the novel composition of the present invention may include a coloring agent, such that the applied composition is easily seen against the blanket backing. A preferred color is emerald green.

My novel composition is applied to the fabric backing of a printing blanket being treated. Generally, the thick viscous liquid is liberally applied. For example, in the case of the very highly preferred formulation of Example 1 described later, approximately three ounces will be sufficient for a 48"×61" blanket. Advantageously, a damp rag is used for application, and a dry rag is employed to remove excess. Restoration occurs nearly immediately upon application of the composition.

To use my novel composition to restore a printing blanket having a small area requiring restoration, the thick viscous liquid is typically applied to the fabric area requiring restoration and to the immediately surrounding fabric area. Excess is removed and the blanket is ready to be secured to the appropriate cylinder and used.

For pre-treating a new blanket, the novel composition of the present-invention should be spread evenly over the fabric backing, and excess removed after which the blanket is ready for use. For restoring an old blanket requiring extensive restoration, all foreign matter should be removed from the fiber backing prior to applying the thick viscous liquid, and then the same procedure as is used for pre-treating a new blanket should be carried out.

In the Examples and Comparative Examples that follow and throughout this description and the claims set forth below, all percentages are by weight/weight, and all procedures are carried out at ambient temperature and pressure, unless otherwise specified.

EXAMPLE 1

To 3500 lbs. of water, there is added 500 lbs. of dodecylbenzenesulfonic acid and 110 lbs. of potassium hydroxide, to form the potassium salt of the sulfonic acid. To the resulting solution is added 150 lbs. of a sodium lauryl sulfate solution of 30% active concentration, 100 lbs. of 34% solids cocamidopropylbetaine (30% active concentration cocamidopropylbetaine), 100 lbs. of a nonionic surfactant containing 83% of a $C_{12-14}$-alkyloxypolyethylenoxyethanol having an average of 12 moles ethylene oxide per molecule, and 17% of a $C_{12-14}$-alkyloxypolyethylenoxyethanol having an average of 5 moles of ethylene oxide per molecule, 50 lbs. of a phosphated n,n-bis(hydroxyethyl) coco amine oxide potassium salt solution containing 33–35% solids, 25 lbs. of sodium chloride, 10 lbs. of a 38% EDTA solution, and 8 lbs. of a 37% formaldehyde solution. The betaine is available from Jordan Chemical Company under the name Jortaine CAB-35, the nonionic surfactant is sold by Union Carbide under the trade mark Tergitol® Autoseptic® HD, PM 4870, and the phosphate ester is available from the Jordan Chemical Company as Jorphox KCAO. The resulting mixture is stirred until uniform, and water is added to reach a total weight of 4750 lbs. A thick viscous liquid is formed having the percentage of components shown in Table 1.

EXAMPLES 2–10

Employing the procedure of Example 1 on a reduced scale, thick viscous liquids having the formulations shown in Tables 1 and 2, are produced.

TABLE 1

| | EXAMPLES | | | | |
|---|---|---|---|---|---|
| | 1 | 2 | 3 | 4 | 5 |
| sodium lauryl sulfate | 4% | 4% | 4% | 4% | 4% |
| cocamidopropyl-betaine | 2% | 2% | 2% | — | 2% |
| organic phosphate | 2% | 2% | 2% | 2% | 2% |

TABLE 1-continued

| | EXAMPLES | | | | |
|---|---|---|---|---|---|
| | 1 | 2 | 3 | 4 | 5 |
| ester | | | | | |
| nonionic surfactant | 4% | 4% | — | 4% | 4% |
| sodium dodecyl-benzene sulfonate | 10% | 10% | 10% | 10% | 10% |
| sodium chloride | 1% | — | 1% | 1% | 1% |
| EDTA | 1% | — | — | — | — |
| formaldehyde | 0.02% | — | — | — | — |
| water to | 100% | 100% | 100% | 100% | 100% |

TABLE 2

| | EXAMPLES | | | | |
|---|---|---|---|---|---|
| | 6 | 7 | 8 | 9 | 10 |
| sodium lauryl sulfate | 2% | 4% | 4% | 4% | 4% |
| cocamidopropyl-betaine | 2% | 2% | 1% | 2% | 2% |
| organic phosphate ester | 2% | 2% | 2% | 1% | 2% |
| nonionic surfactant | 4% | 4% | 4% | 4% | 2% |
| sodium dodecyl-benzene sulfonate | 10% | 5% | 10% | 10% | 10% |
| water to | 100% | 100% | 100% | 100% | 100% |

COMPARATIVE EXAMPLES 1-5

The procedure of Example 1 is followed on a scaled down basis, to produce compositions having the formulations shown in Table 3.

TABLE 3

| | COMPARATIVE EXAMPLES | | | | |
|---|---|---|---|---|---|
| | 1 | 2 | 3 | 4 | 5 |
| sodium lauryl sulfate | 4% | 4% | 4% | 4% | — |
| cocamidopropyl-betaine | 2% | 2% | 2% | 2% | 2% |
| organic phosphate ester | 2% | 2% | — | 2% | 2% |
| nonionic surfactant | 4% | — | — | 4% | 4% |
| sodium dodecyl-benzene sulfonate | — | 10% | 10% | — | 10% |
| sodium chloride | — | — | — | 1% | 1% |
| water to | 100% | 100% | 100% | 100% | 100% |

EXAMPLE 11

The procedure of Example 2 is followed except that ammonium lauryl sulfate is substituted for sodium lauryl sulfate in an amount sufficient to provide the thick viscous liquid with 4 wt. % of this sulfate salt.

EXAMPLE 12

The procedure of Example 2 is followed except that coco betaine is substituted for cocoamido betaine in an amount sufficient to provide the thick viscous liquid with 2 wt. % of this betaine.

EXAMPLE 13

The procedure of Example 2 is followed except that a polyoxyethylene(4)decyl ether phosphate, available as Cedephos FA-600M from Miranol Chemical Company, is substituted for the phosphate ester used therein in an amount sufficient to provide the thick viscous liquid with 2 wt. % of this phosphate ester.

BLANKET TREATMENT

To a printing blanket having a smashed area, the thick viscous liquid of Example 1 is liberally applied to the fabric area requiring restoration and to the immediately surrounding fabric area. Excess is removed, the blanket is secured to the cylinder, and the blanket is run using blue ink. Table 4 shows the percent restoration of the blanket.

This procedure is repeated for the thick viscous liquids of Examples 2-13 and the compositions of Comparative Examples 1-5, and the results obtained are shown in Table 4.

TABLE 4

| Example | % Restoration | Compar. Example | % Restoration |
|---|---|---|---|
| 1 | 100 | 1 | 90 |
| 2 | 100 | 2 | 90 |
| 3 | 95 | 3 | 0 |
| 4 | 100 | 4 | 78 |
| 5 | 100 | 5 | 90 |
| 6 | 95 | | |
| 7 | 95 | | |
| 8 | 95 | | |
| 9 | 100 | | |
| 10 | 98 | | |
| 11 | 100 | | |
| 12 | 100 | | |
| 13 | 100 | | |

The above examples are illustrative of the present invention. It is to be understood that these examples are not in any way to be interpreted as limiting the scope of this invention. Rather, it is intended that the scope of this invention be defined by the claims set forth below. I contemplate that the invention as hereinafter claimed, will be subject to various modifications, which modifications are within the scope hereof.

INDUSTRIAL APPLICABILITY

The novel composition of the present invention is useful for restoring a conventional printing blanket having an unmarred or unbroken elastomeric face but in need of restoration, in particular a smashed printing blanket.

I claim:

1. A thick viscous liquid composition useful for restoring a printing blanket having an unmarred or unbroken elastomeric face but in need of restoration due to compression of the fabric backing thereof, said composition consisting essentially of as ingredients in a water solvent, (a) about 1-10 of a sulfated fatty alcohol anionic surfactant, from about 3 to about 20% of a sulfonated alkylaryl anionic surfactant, and from about 0.5 to about 10% of an organic phosphate ester surfactant, and (b) either (1) from about 1 to about 10% of a nonionic surfactant, or (2) from about 0.5 to about 2% of a water-soluble salt and from about 1 to about 8% of an amphoteric surfactant other than an amphoteric organic phosphate ester surfactant;

wherein said ingredients are individually present in an amount sufficient to provide said restoring upon a sufficient amount of said composition being applied to said fabric backing.

2. The composition of claim 1, comprising said nonionic surfactant.

3. The composition of claim 1, comprising said amphoteric surfactant and said water-soluble salt.

4. The composition of claim 2, further comprising said amphoteric surfactant.

5. The composition of claim 2, further comprising said water-soluble salt.

6. The composition of claim 4, further comprising said water-soluble salt, a chelating agent and a preservative.

7. The composition of claim 6, further comprising a coloring agent.

8. The composition of claim 1, wherein said sulfated fatty alcohol anionic surfactant is sodium or ammonium lauryl sulfate.

9. The composition of claim 1, wherein said organic phosphate ester surfactant is an alkali metal salt of a phosphated, ethoxylated, $C_{8-18}$-alkyl and $C_{8-18}$-alkenylamine oxide, which may be amphoteric at approximately neutral pH.

10. The composition of claim 1, wherein said organic phosphate ester surfactant is a free-acid form of an anionic, polyethoxylated $C_{8-12}$-alkyl ether phosphate having about 2 to 6 oxyethylene groups per alkylether chain.

11. The composition of clami 1, wherein said sulfonated alkylaryl anionic surfactant is an alkali metal dodecylbenzene sulfonate.

12. The composition of claim 1, wherein said amphoteric surfactant is a betaine.

13. The composition of claim 1, wherein said water-soluble salt is an alkali metal halide.

14. The composition of claim 1, wherein said nonionic surfactant is an alkyloxypolyethylenoxyethanol having a $C_{12-14}$-alkyl group.

15. The composition of claim 1, comprising about 4–8 of said sulfated fatty alcohol anionic surfactant and from about 9 to about 16% of said sulfonated alkylaryl anionic surfactant.

16. The composition of claim 1, comprising about 1–8% of said organic phosphate ester surfactant.

17. The composition of claim 1, comprising about 2–8% of said nonionic surfactant.

18. The composition of claim 1, comprising a small amount of said water-soluble salt, and about 2 to 6% of said amphoteric surfactant.

* * * * *

UNITED STATES PATENT AND TRADEMARK OFFICE

CERTIFICATE OF CORRECTION

PATENT NO. : 4,784,777

DATED : November 15, 1988

INVENTOR(S) : Matthew Dellinger

It is certified that error appears in the above-identified patent and that said Letters Patent is hereby corrected as shown below:

Column 8, line 46, after "1-10" insert -- % --.

Column 10, line 11, after "4-8" insert -- % --.

Signed and Sealed this

Twelfth Day of June, 1990

*Attest:*

HARRY F. MANBECK, JR.

*Attesting Officer*

*Commissioner of Patents and Trademarks*